United States Patent [19]

Mertz et al.

[11] 4,168,239

[45] Sep. 18, 1979

[54] FIRE SUPPRESSING CONCENTRATES

[75] Inventors: Richard E. Mertz; Thomas J. Falkler, both of St. Louis, Mo.

[73] Assignee: Petrolite Corporation, St. Louis, Mo.

[21] Appl. No.: 937,305

[22] Filed: Aug. 25, 1978

Related U.S. Application Data

[63] Continuation of Ser. No. 508,408, Sep. 23, 1974, abandoned.

[51] Int. Cl.[2] ..... A62D 1/00

[52] U.S. Cl. ..... 252/2; 252/7; 252/8.05; 252/312; 252/313 S

[58] Field of Search ..... 252/2, 7, 8.05, 312, 252/313 S

[56] References Cited

U.S. PATENT DOCUMENTS

| | | | |
|---|---|---|---|
| 3,196,108 | 7/1965 | Nelson | 252/7 |
| 3,245,904 | 4/1966 | Young | 252/7 |
| 3,553,128 | 1/1971 | Wilson | 252/2 |
| 3,585,135 | 6/1971 | Smith et al. | 252/7 |
| 3,617,095 | 11/1971 | Lissant | 252/312 |
| 3,634,234 | 1/1972 | Morgenthaler | 252/7 |
| 3,637,022 | 1/1972 | Kelly et al. | 252/2 |
| 3,730,890 | 5/1973 | Nelson | 252/8.05 |
| 3,775,315 | 11/1973 | Smith et al. | 252/2 |

*Primary Examiner*—Leland A. Sebastian

*Attorney, Agent, or Firm*—Sidney B. Ring; Hyman F. Glass

[57] ABSTRACT

This invention relates to high internal phase ratio emulsions of colorant-containing fire suppressant concentrates which are non-settling and non-abrasive to high pressure, close tolerance pumps. These non-settling, non-abrasive concentrates can be prepared, stored, and diluted with water for use in both aerial and ground fire fighting.

7 Claims, No Drawings

FIRE SUPPRESSING CONCENTRATES

This is a continuation, of application Ser. No. 508,408, filed Sept. 23, 1974 now abandoned In tests by the Southern Forest Fire Laboratory of the U.S. Department of Agriculture, it was found that solutions (8 percent $P_2O_5$) of mono- or diammonium phosphate were very effective materials to use in fighting forest and rangeland fires. Studies in 1965 showed that an 8 percent $P_2O_5$ solution made by diluting a concentrated ammonium polyphosphate solution (11 percent nitrogen and 37 percent $P_2O_5$) was equally effective. Use of this liquid concentrate instead of the more expensive and difficult to handle dry salts, simplified preparation of the retardant solutions.

Large scale production of concentrated ammonium polyphosphate is concerned with two concentrations: (1) one containing 11 percent nitrogen and 37 percent $P_2O_5$ (11-37-0) with about 65 to 80 percent of its $P_2O_5$ as polyphosphates and the remainder as orthophosphate and (2) one containing 10 percent nitrogen and 34 percent $P_2O_5$ with about 50% of its $P_2O_5$ as polyphosphates and 50 percent as orthophosphate. These liquids are produced by ammoniation of electric furnace superphosphoric acid or from wet process superphosphoric acid. Table 1 gives typical properties of concentrated ammonium polyphosphates from electric furnace (11-37-0) and wet process (10-34-0) superphosphoric acid.

Ammonium polyphosphates have the same general formula as ammonium orthophosphates $(NH_4H)_{n+2}PO_{3n+1}$) but differ in the number of phosphorus atoms in a molecule. In the orthophosphates n=1 and common salts are mono- ammonium and diammonium orthophosphate, $NH_4H_2PO_4$ and $(NH_4)_2HPO_4$ respectively.

Table I

| Typical Properties | 11-37-0 | 10-34-0 |
|---|---|---|
| Water content, % of total wt. | 40 | 40 |
| Nitrogen, % N by wt. | 11–11.5 | 10 min. |
| Phosphate, % $P_2O_5$by wt. | 37–38 | 34 min. |
| Density, Lb/gal at 75° F. | 11.7 | 11.7 |
| Nitrogen content, Lb N/gal | 1.31 | 1.18 |
| Phosphate content, Lb $P_2O_5$/gal | 4.34 | 4.01 |
| Polyphosphate content % of total $P_2O_5$ | 65–80 | 50–60 |
| Viscosity, cps. at 60° F. | 120 | 50–75 |
| pH | 5.8–6.2 | 6.0–6.2 |

The polyphosphates have 2 or more atoms of phosphorus in a chain configuration (n=2 or more); examples are pyrophosphates $(NH_4, H)_4P_2O_7$, tripolyphosphates $(NH_4, H)_5P_3O_{10}$, and tetrapolyphosphates $(NH_4,H)_6P_4O_{13}$.

The use of these concentrated polyphosphates has been hampered due to the difficulty in incorporating colorants into the concentrate in sufficient amounts such that when the concentrate is diluted with water the resulting solution must be visible for aerial and ground tanker application so that consecutive drops or tanker applications can be effectively tied together into a single fire retardant line. Tests were conducted by the Bureau of Land Management and the U.S. Forest Service in Fairbanks, Alaska, where a liquid 10-34-0 concentrate was tested on uncontrolled fire fronts. The noted disadvantage of the polyphosphates tested was lack of color. The diluted concentrate solutions were not visible to the pilots of the fire attack aircraft and made tying together consecutive drops nearly impossible.

Methods for incorporating suitable amounts of appropriate pigments were required. These required that the concentrate have sufficient quantity of pigment, mainly iron oxide, such that when diluted 4 parts water to 1 part concentrate or 6 parts water to 1 part concentrate, the resulting solution when applied is visible from the air and on the ground. One solution was to use clay as a thickener for the 10-34-0 concentrate such that a sufficient amount of iron oxide could be incorporated in the concentrate which when diluted would provide adequate coloring to the drop pattern and yet not settle out or separate from the concentrate over prolonged storage and the concentrate could be easily dispersed or diluted with water just prior to being applied. The principle difficulty with this approach is that the use of clay as a thickener for the concentrate introduces an extremely abrasive material into the formula and the resulting dilution with water causes excessive wear and damage in high pressure, close tolerance pumping equipment in normal ground tanker fire fighting equipment. While the use of clay thickened ammonium polyphosphate liquids with colorants is acceptable for aerial fire fighting applications because close tolerance high pressure pumping equipment is not required, the net result is that additional and separate stocks of unpigmented retardant concentrates must be made available for ground tanker application in which case the fire retardant line applied from ground tankers is unpigmented. This has resulted in the limited application of these liquid polyphosphate concentrates in ground applied methods and in conjunction with aerially applied retardants.

We have now discovered that these liquid fire suppressant concentrates, including ammonium polyphosphate solutions, can be incorporated into fire suppressant compositions containing the appropriate amounts of colorants, corrosion inhibitors, etc. in an easily water diluted form and yet the concentrate remains as a stable, nonsettling form over prolonged storage periods. This fire suppressing composition is in the form of a high internal phase ratio emulsion wherein the fire retardant chemical, such as ammonium polyphosphate, pigment and other ingredients are mixed and then added to an oily emulsifier mixture, resulting in a concentrate that is a non-settling, stable emulsion which is easily diluted with water in the pumping equipment employed in both aerial and ground tanker operations without the resulting damage to pumping equipment.

In contrast to the above fire retardant concentrates, the compositions described in U.S. Pat. No. 3,196,108 employ attapulgite clay to prepare fire retardant concentrates as an essential component thereof. However, such clay severely damages the high pressure, close tolerance pumps employed to handle such formulations. The present invention avoids the use of damaging clays.

One or more fire suppressing chemicals can be used in these formulations, either singly or in combination with each other, including inorganic bases, inorganic acids, salts of inorganic acids, and heat labile organic acid amides or salts, hereinafter referred to as soluble fire retarding and suppressing materials.

It will be noted that the maximum amount of fire retardant material, in the present composition, is determined by its solubility to saturation in water, while its minimum amount is determined by desired fire retardant effectiveness such as that which will extinguish or prevent the spread of a fire.

These may include various materials, such as ammonium sulfate, diammonium phosphate, monoammonium phosphate, sulfamic acid, phosphoric acid, or urea, ammonium chloride, or the like. These materials have low mammalian toxicity, all have good fire suppressing character, and are quite economical from the standpoint of initial cost. Furthermore, these materials are economical to apply since nominal amounts of them are required in an aqueous solution to obtain effective fire control and/or extinction.

It has been found that sodium phosphates, including sodium tri-polyphosphate, tetra-sodium pyrophosphate, sodium hexametaphosphate, tri-sodium phosphate, or similar materials, when added to the composition of the present invention, cause said composition, when dry, to become a hard tough film which has a tenacious ability to stay on flora or other fuel materials.

These improved high internal phase ratio emulsion formulations are easily handled. These are, in essence, formulation concentrates which can be further converted into formulations which are actually employed in fire fighting either as gels or emulsions or diluted solutions. Stated another way, they are pre-firefighting concentrates which can subsequently be diluted with water to produce a fire suppressing composition without severely damaging or erroding the delivery equipment. These water dilutions can subsequently be further formulated with other materials to produce gels or emulsions for use in fighting fires.

The benefits derived from this invention relate to improvements achieved through the properties and characteristics of high internal phase ratio emulsions. For example, since no abrasive clay or other suspending agent is used in these formulations, they can be used in ground tanker applications which require close tolerance, high pressure pumping equipment as well as in aerial application where close tolerance, high pressure pumps are not generally employed. Therefore only one supply point is required for this dual ground-aerial application. These novel concentrates are easily diluted with water using standard fire fighting equipment. These concentrates, being oil external emulsions, also greatly reduce the corrosive nature of the fire retardant chemical contained in the internal phase. These concentrates also enable the use of a variety of colorants to mark the areas of application. These colorants can be water soluble, oil soluble or insoluble pigments which are held in suspension by the structure of the high internal phase emulsion.

Fluorescent material or coloring agents utilized in the composition of the present invention act to identify or color the areas on which the composition has been applied so that subsequent applications to adjacent areas permit a pilot or ground tanker operator to form a continuous firebreak with great precision.

The coloring agent may be red iron oxide or ultramarine blue. A suitable illuminating or fluorescent material known to those skilled in the art may be used for night application to lend target identity to the composition.

Corrosion inhibitors in the composition are used to neutralize any corrosive character of the fire suppressing materials. As for example, some of these materials may be slightly corrosive to the mixing and application equipment of aerial or ground transport tanks, and for this reason, the corrosion inhibitor is utilized.

The corrosion inhibitor may include sodium silicofluoride, sodium di-chromate, potassium dichromate, chromic acid, sodium thiosulphate, or they can be of the oil soluble type such as imidazoles, amides, amino-types or other effective materials.

The emulsions employed in this invention are high internal phase ratio emulsions. These high internal phase ratio emulsions are pseudo-plastic fluids; that is, rather than exhibiting Newtonian viscosity properties, the apparent viscosity of the formulation is a function of the rate of shear. Simply stated, these fluids behave like elastic solids when at rest or when subjected to forces below their yield point. Above their yield point they begin to flow, and at normal pumping velocities their viscosity is close to the viscosity of the external phase employed. We have found that such emulsions can be pumped through a pipe inexpensively and effectively. These emulsions contain an internal phase which is the major part of the emulsions; for example, at least about 60%, such as at least about 80%, but preferably in excess of about 90% by volume.

The thixotropic emulsions of this invention, which have the characteristics of solids at rest and liquids when force is exerted on them, have the following advantages:

(1) Nonadhesive—They do not tend to stick to the sides of the container or piping system.

(2) Viscosity—The apparent rest viscosity is generally greater than 1000 cps. However, under low shear, they will flow with a viscosity approaching that of the liquid phases. On removal of shear, the recovery to original apparent rest viscosity is nearly instantaneous. The hysteresis loop is very small.

(3) Temperature stability—Increased temperature has little effect on viscosity until the critical stability temperature is reached at which point the emulsion breaks into its liquid components. This permits a wide temperature range of operation.

(4) Shear stability—Emulsions may be subjected repeatedly to shear without degradation so long as the critical shear point is not reached. At this point the emulsion breaks. However, the critical shear point is sufficiently high to permit pumping at high rates.

(5) Quality control—With these emulsions it is easy to reproduce batches with identical properties due to the absence of any "gel" structure.

The following patents, which are by reference incorporated into the present application, relate to stable, viscous thixotropic high internal phase ratio emulsions and to the uses, preparation, etc., of these emulsions. They describe the type of emulsions, the general processes of preparation, the type of emulsifiers employed, etc.

| | |
|---|---|
| U.S.P. 3,343,599 | METHOD OF REDUCING THE POROSITY OF SUBTERRANEAN POROUS FORMATIONS |
| U.S.P. 3,352,109 | HYBRID THIXOTROPIC ROCKET AND JET FUELS COMPRISING OIL IN WATER EMULSIONS |
| U.S.P. 3,378,418 | METHOD OF RESOLVING THIXOTROPIC JET AND ROCKET FUEL EMULSIONS |
| U.S.P. 3,396,537 | HYBRID FUEL II |
| U.S.P. 3,490,237 | THIXOTROPIC OIL-IN-WATER EMULSION FUELS |
| U.S.P. 3,523,826 | PROCESS OF CLEANING PIPING SYSTEMS |
| U.S.P. 3,539,406 | ESSENTIALLY NONAQUEOUS EMULSIONS |

-continued

| | |
|---|---|
| U.S.P. 3,565,817 | CONTINUOUS PROCESS FOR THE PREPARATION OF EMULSIONS |
| U.S.P. 3,613,372 | METHOD OF PROVIDING POWER WITH ESSENTIALLY NONAQUEOUS EMULSIONS |
| U.S.P. 3,617,095 | METHOD OF TRANSPORTING BULK SOLIDS |

The type of thixotropic emulsions described herein have been amply described in the above patents. It should be noted that these emulsions can be prepared by any suitable emulsifying agent. Although oxyalkylates are preferred, other types of suitable emulsifiers can be employed.

By using the means of selecting suitable emulsifiers described in the above applications, one can select and employ emulsifiers, for example, of the following types:

(I) ANIONIC (A) Carboxylic acids:
- (1) Carbonyl joined directly to the hydrophobic group (subclassification on basis of the hydrophobic group), e.g. fatty acids, soaps, rosin soaps, etc.
- (2) Carboxyl joined through an intermediate linkage.
  - (a) Amide group as intermediate link.
  - (b) Ester group as intermediate link.
  - (c) Sulfoamide group as intermediate link.
  - (d) Miscellaneous intermediate links, ether, $—SO_2—$, —S—, etc.

(B) Sulfuric esters (sulfates)
- (1) Sulfate joined directly to hydrophobic group.
  - (a) Hydrophobic group contains no other polar structures (sulfated alcohol and sulfated olefin type).
  - (b) Sulfuric esters with hydrophobic groups containing other polar structures (sulfated oil type).
- (2) Sulfate group joined through intermediate linkage.
  - (a) Ester linkage (Artic Syntex M. type).
  - (b) Amide linkage (Xynomine type).
  - (c) Ether linkage (Triton 770 type).
  - (d) Miscellaneous linkages (e.g., oxyalkylimidazole sulfates).

(C) Alkane sulfonic acids
- (1) Sulfonic group directly linked
  - (a) Hydrophobic group bears other polar substituents ("highly sulfate oil" type). Chloro, hydroxy, acetoxy, and olefin sulfonic acids (Nytron type).
  - (b) Unsubstituted alkane sulfonic acid (MP 189 type; also cetane sulfo acid type).
  - (c) Miscellaneous sulfonic acids of uncertain structure, e.g., oxidation products of sulfurized olefins, sulfonated rosin, etc.
- (2) Sulfonic groups joined through intermediate linkage.
  - (a) Ester linkage.
    - (1) $RCOO—X—SO_3H$ (Igepon AP type).
    - (2) $RNHOC—X—SO_3H$ (sulfosuccinamide type).
  - (b) Amide linkage.
    - (1) $RCONH—X—SO_3H$ (Igepon T type).
    - (2) $RNHOC—X—SO_3H$ (sulfosuccinamide type).
  - (c) Ether linkage (Triton 720 type).
  - (d) Miscellaneous linkages and two or more linkages.

(D) Alkyl aromatic sulfonic acids
- (1) Hydrophobic group joined directly to sulfonated aromatic nucleus (subclasses on basis of nature of hydrophobic group. Alkyl phenols, terpene, and rosin-aromatic condensates, alkyl aromatic ketones, etc.).
- (2) Hydrophobic group joined to sulfonated aromatic nucleus through as intermediate linkage.
  - (a) Ester linkage (sulfophthalates, sulfobenzoates).
  - (b) Amide and imide linkages.
    - (1) $R—CONH—ArSO_3H$ type.
    - (2) Sulfobenzamide type.
  - (c) Ether linkage (alkyl phenyl ether type).
  - (d) Heterocyclic linkage (Ultravon type, etc.).
  - (e) Miscellaneous and two or more links.

(E) Miscellaneous anionic hydrophilic groups
- (1) Phosphates and phosphonic acids.
- (2) Persulfates, thiosulfates, etc.
- (3) Sulfonamides.
- (4) Sulfamic acids, etc.

(II) CATIONIC (A) Amine salts (primary, secondary, and tertiary amines)
- (1) Amino group joined directly to hydrophobic group.
  - (a) Aliphatic and aromatic amino groups.
  - (b) Amino group is part of a heterocyle (alkaterge type).
- (2) Amino group joined through an intermediate link.
  - (a) Ester link.
  - (b) Amide link.
  - (c) Ether link.
  - (d) Miscellaneous links.

(B) Quaternary ammonium compounds.
- (1) Nitrogen joined directly to hydrophilic group.
- (2) Nitrogen joined through an intermediate link.
  - (a) Ester link.
  - (b) Amide link.
  - (c) Ether link.
  - (d) Miscellaneous links.

(C) Other nitrogenous bases
- (1) Non-quaternary bases (classified as guanidine, thiuronium salts, etc.).
- (2) Quaternary bases.

(D) Non-nitrogenous bases
- (1) Phosphonium compounds.
- (2) Sulfonium compounds, etc.

(III) NON-IONIC (A) Ether linkage to solubilizing groups.
(B) Ester linkage.
(C) Amide linkage.
(D) Miscellaneous linkages.
(E) Multiple linkages.

(IV) AMPHOLYTIC (A) Amino and carboxyl
- (1) Non-quaternary.
- (2) Quaternary.

(B) Amino and sulfuric ester
- (1) Non-quaternary.
- (2) Quaternary.

(C) Amine and alkane sulfonic acid.
(D) Amine and aromatic sulfonic acid.
(E) Miscellaneous combinations of basic and acidic groups.

The following examples are given only as illustrations and not limitations.

Emulsifier A

An emulsifier was prepared by oxyethylating dinonyl phenol with 1.37 parts by weight ethylene oxide.

Emulsifier B

An emulsifier was prepared by oxyethylating a long chain aliphatic primary fatty amine with 0.4 parts by weight ethylene oxide.

Emulsifier C

An emulsifier was prepared by oxyethylating a dinonyl phenol with 1.2 parts by weight ethylene oxide and blending 24.4 parts by weight of this oxyethylate with 19.5 parts of a long chain aliphatic primary amine and 7.3 parts by weight acetic acid.

EXAMPLE 1

A vessel was mounted directly over the inlet of a gear pump driven by a variable speed motor running at 600 rpm. The discharge of the pump was routed back to the top of the vessel such that material introduced into the container could be pumped out, through the pump and back into the container. 216 volumes of an aliphatic hydrocarbon containing 10% by weight red oil soluble dye and 144 volumes of Emulsifier A are placed in the vessel and the material circulated through the pump. While circulating this mixture 4140 volumes of 10-34-0 ammonium polyphosphate was slowly added. Circulation was continued until a uniform mixture was achieved. The resulting mixture had a dark red, jelly-like appearance.

EXAMPLE 2

A vessel, a split-disk stirrer and a variable speed stirring motor is set up so that the stirrer is situated as close to the bottom of the vessel as possible. The stirrer can be raised and lowered during the mixing operation.

10 parts by weight of Emulsifier B and 7.6 parts by weight of an aliphatic hydrocarbon are placed in the vessel, and the stirrer motor set at about 900 rpm. To this mixture 115 parts of an ammonium polyphosphate (10-34-0) containing 1.65 parts by weight iron oxide are added in small increments. As the liquid level in the vessel rises, the stirrer is raised and lowered to insure uniform and thorough mixing. The resulting mixture is a viscous red psuedoplastic emulsion.

EXAMPLE 3

Using the mixing procedure of Example 2, 5 volumes of Emulsifier C and 5 volumes of kerosene were placed in a vessel. To this mixture 80 volumes of a mixture of ammonium polyphosphate (10-34-0) containing 1.5% by weight 6BL red dye were slowly added producing a red viscous emulsion of the type desired.

These emulsions can also be produced on a continuous basis as outlined in patents previously referenced.

These fire suppression compositions have good thermal stability, excellent dilution characteristics, excellent non-abrasive characteristics, low corrosivity and excellent compatability with existing fire fighting equipment.

In summary, the present invention comprises nonsettling, non-abrasive high internal phase ratio emulsion concentrates containing a fire suppressing chemical and a colorant, and other such additives such as a corrosion inhibitor, as are necessary. Since these concentrates can be prepared and pumped in high pressure, close tolerance pumps, they can be employed in both ground and aerial fire fighting applications. This invention consists of fire fighting concentrates that can be easily further diluted with water and applied to the fire fighting situation, or that can be applied as diluted solutions which are subsequently emulsified or gelled prior to being applied to the fire situation. These fire fighting concentrates are further diluted with 1 part concentrate with 1 part to 8 parts of water depending upon the fire situation. These fire fighting concentrates solve the problems associated with fire fighting formulations which contain abrasive clays as the suspending agent and thereby causing severe abrasion problems in high pressure, close tolerance pumping and mixing equipment.

In practice, sufficient colorant is employed to mark the desired area when the concentrate has been diluted and applied to the fire fighting area.

The following are typical concentrates:

| | Broad % wt. Range | Medium % wt. Range | Narrow % wt. Range |
|---|---|---|---|
| Fire Suppressant | 80–98 | 90–97 | 90–95 |
| Colorant | .5–4.0 | 1.0–2.5 | 1.5–2.0 |
| Corrosion Inhibitor | 0–2.5 | .5–2.0 | 1.0–1.5 |
| Oil and emulsifier | 1–20 | 2–10 | 3–8 |

We claim:

1. A thixotropic high internal phase ratio, non-settling water dilutable emulsion concentrate, said emulsion containing an emulsifying agent, an emulsifiable oil, a colorant and a fire suppressant in an aqueous phase, said fire suppressant being selected from the group consisting of ammonium sulfate, diammonium phosphate, ammonium polyphosphates, monoammonium phosphate, sulfamic acid, phosphonic acid, urea and ammonium chloride, said aqueous phase being the internal phase of said emulsion concentrate and being present in an amount of at least about 60% by volume of said emulsion, said emulsion having the characteristics of an elastic solid when at rest and the characteristics of a liquid when a force is exerted upon it.

2. Claim 1 where the colorant contains an insoluble pigment.

3. Claim 2 where the insoluble pigment is red iron oxide.

4. The concentrate of claim 1 where the fire suppressant is ammonium polyphosphate.

5. The concentrate of claim 2 where the fire suppressant is ammonium polyphosphate.

6. The concentrate of claim 3 where the fire suppressant is ammonium polyphosphate.

7. The emulsion concentrate of claim 1 wherein said aqueous internal phase is present in an amount in excess of about 90% by volume of said emulsion.

* * * * *